US010865616B2

(12) United States Patent
Ingram et al.

(10) Patent No.: US 10,865,616 B2
(45) Date of Patent: Dec. 15, 2020

(54) PORTED U-CUP ANNULAR WELLHEAD HANGER SEAL

(71) Applicant: Baker Hughes Oilfield Operations LLC, Houston, TX (US)

(72) Inventors: Andrew Ingram, Cypress, TX (US); Gregory Dunn, Houston, TX (US); Alejandro C. Martinez, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 7 days.

(21) Appl. No.: 16/281,367

(22) Filed: Feb. 21, 2019

(65) Prior Publication Data

US 2019/0257171 A1 Aug. 22, 2019

Related U.S. Application Data

(60) Provisional application No. 62/633,571, filed on Feb. 21, 2018.

(51) Int. Cl.

| | |
|---|---|
| ***E21B 33/043*** | (2006.01) |
| ***E21B 33/12*** | (2006.01) |
| ***E21B 33/038*** | (2006.01) |
| ***E21B 33/035*** | (2006.01) |
| ***E21B 33/04*** | (2006.01) |

(52) U.S. Cl.

CPC ..... *E21B 33/043* (2013.01); *E21B 33/0355* (2013.01); *E21B 33/0385* (2013.01); *E21B 33/04* (2013.01); *E21B 33/1208* (2013.01); *E21B 33/1212* (2013.01); *E21B 2200/01* (2020.05)

(58) Field of Classification Search

CPC ..... E21B 33/043; E21B 33/1208; E21B 33/0355; E21B 33/04; E21B 33/1212; E21B 33/0385; E21B 33/005

USPC ..... 277/338, 339

See application file for complete search history.

(56) References Cited

U.S. PATENT DOCUMENTS

| | | | | |
|---|---|---|---|---|
| 5,285,853 A * | 2/1994 | Eckert | E21B 33/04 | 166/382 |
| 5,318,127 A * | 6/1994 | Hines | E21B 34/10 | 166/321 |
| 7,861,789 B2 * | 1/2011 | Nelson | E21B 33/043 | 166/196 |
| 8,146,670 B2 * | 4/2012 | Ellis | E21B 33/04 | 166/368 |

(Continued)

*Primary Examiner* — D. Andrews
*Assistant Examiner* — Manuel C Portocarrero
(74) *Attorney, Agent, or Firm* — Hogan Lovells US LLP

(57) ABSTRACT

A system is disclosed as including an enclosed space within a seal for sealing an area between a hanger and a housing of a wellhead. The enclosed space traverses a first section of the seal, a middle section of the seal, and an opening at a second section of the seal. A port is provided as accessible from the housing. A tool positions the seal within the hanger and the housing so that the port is able to access the enclosed space from the housing to the hanger. A pressure applicator applies fluid into the port at a pressure, which is monitored to determine integrity of the seal. In a monitoring mode, a pressure is monitored at the port. A change in the pressure from an ambient pressure at the port may indicate an on-going issue with the seal. Methods applied to the system are also disclosed.

20 Claims, 8 Drawing Sheets

(56) References Cited

U.S. PATENT DOCUMENTS

| | | | | |
|---|---|---|---|---|
| 9,376,882 | B2 * | 6/2016 | Theiss | E21B 33/1285 |
| 2005/0284640 | A1 * | 12/2005 | Borak, Jr. | E21B 33/047<br>166/369 |
| 2017/0362910 | A1 * | 12/2017 | Stephens | E21B 33/143 |

* cited by examiner

PORTED U-CUP ANNULAR WELLHEAD HANGER SEAL

RELATED APPLICATIONS

The present application is related to and claims priority from provisional application titled "PORTED U-CUP ANNULAR WELLHEAD HANGER SEAL," application No. 62/633,571, filed Feb. 21, 2018, the entirety of which is incorporated by reference herein.

BACKGROUND

Hangers, such as casing and/or tubing hangers, are used in offshore (subsea and surface) and onshore oil and gas rigs for various purposes. In an example, the casing hanger forms part of the wellhead and is lowered into the wellbore to an appropriate depth and rested on a shoulder inside the wellhead. The casing hanger may also be suspended in its position. The casing hanger may be provided for hanging the casing pipe. The casing hangers may be provided in a stack configuration, with narrowing internal diameters (IDs) to provide a shoulder for resting each subsequent casing hanger with subsequently smaller ID. The annulus between each casing hanger and housing is sealed. Such a seal provides a pressure and temperature-resistant seal between the hanger and the wellhead. The seal performance, however, may be unknown after application and this could be a cause for failure in due course of usage.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Systems and methods in accordance with various embodiments of the present disclosure may overcome the aforementioned and other deficiencies experienced in conventional approaches to providing seals that are capable of withstanding high temperature and high pressure, and are capable of being monitored for integrity after application. In particular, the seals may be in the form of ported U-cups with ported paths or added grooves for a port between the seals that may be accessible via the housing. Such an implementation avoids a requirement for additional holes to be cut in other components to accommodate testing or monitoring of the sealing provided by U-cups, generally. For example, such additional holes may cause structural failure to the seal itself in the high temperature and high pressure environment.

Various other functions can be implemented within the various embodiments as well as discussed and suggested elsewhere herein.

Figure 1:
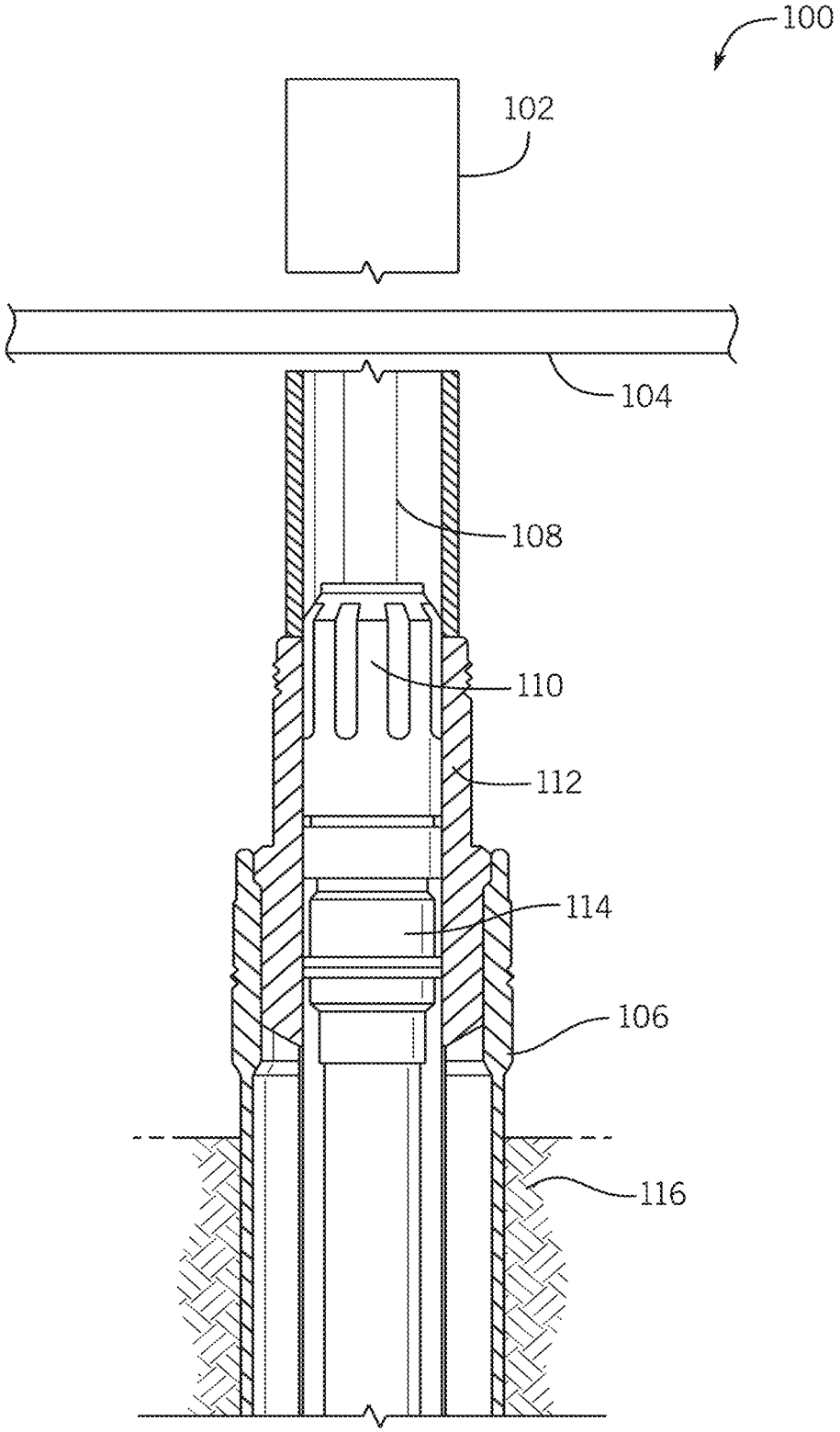
FIG. 1 illustrates an example of wellbore with casing hanger applied in a housing in accordance with various embodiments.

FIG. 1 illustrates an example 100 of wellbore with a casing hanger applied in a housing, in accordance with various embodiments. In the example 100, region 116 may represent subsea or offshore environment with the wellbore penetrating the environment for oil and gas use. The wellbore 106 may include a wellhead 112, and tubing or casing hanger 114, which may be moved into place with a running tool 110. External wellhead support structure 106 (e.g., surface casing) supports the wellhead 112 and additional casings within the wellhead. Strings of pipes are provided to approach the required depth for placement and drilling. For example running string or landing string 108 may be used to place the hanger 114 in its position in the wellhead 112. In addition, a platform 104 may be available in example 100, where equipment in module 102 is provided for power, communication, and monitoring between the wellhead 112 and external structures.

A person of ordinary skill reading the present disclosure would recognize that such equipment in module 100 may comprise a power unit for providing power through the strings into the wellbore, but also for controlling the drilling into the wellbore. The power unit may be located near the strings, at about the center of the platform 104. In addition, the module 100 may include a communications outpost for providing communications to other units, such as a subsea electronics module (SEM). In addition, in subsea implementations, the platform 104 is at the surface of the sea, while the wellhead 112 and the SEM are located at subsea levels. The power unit may be coupled with the communications to allow for redundancy and singular cable transmission through the wellhead, while providing sufficient room for drilling via rotation of the appropriate strings—e.g., string 108.

Figure 2A:
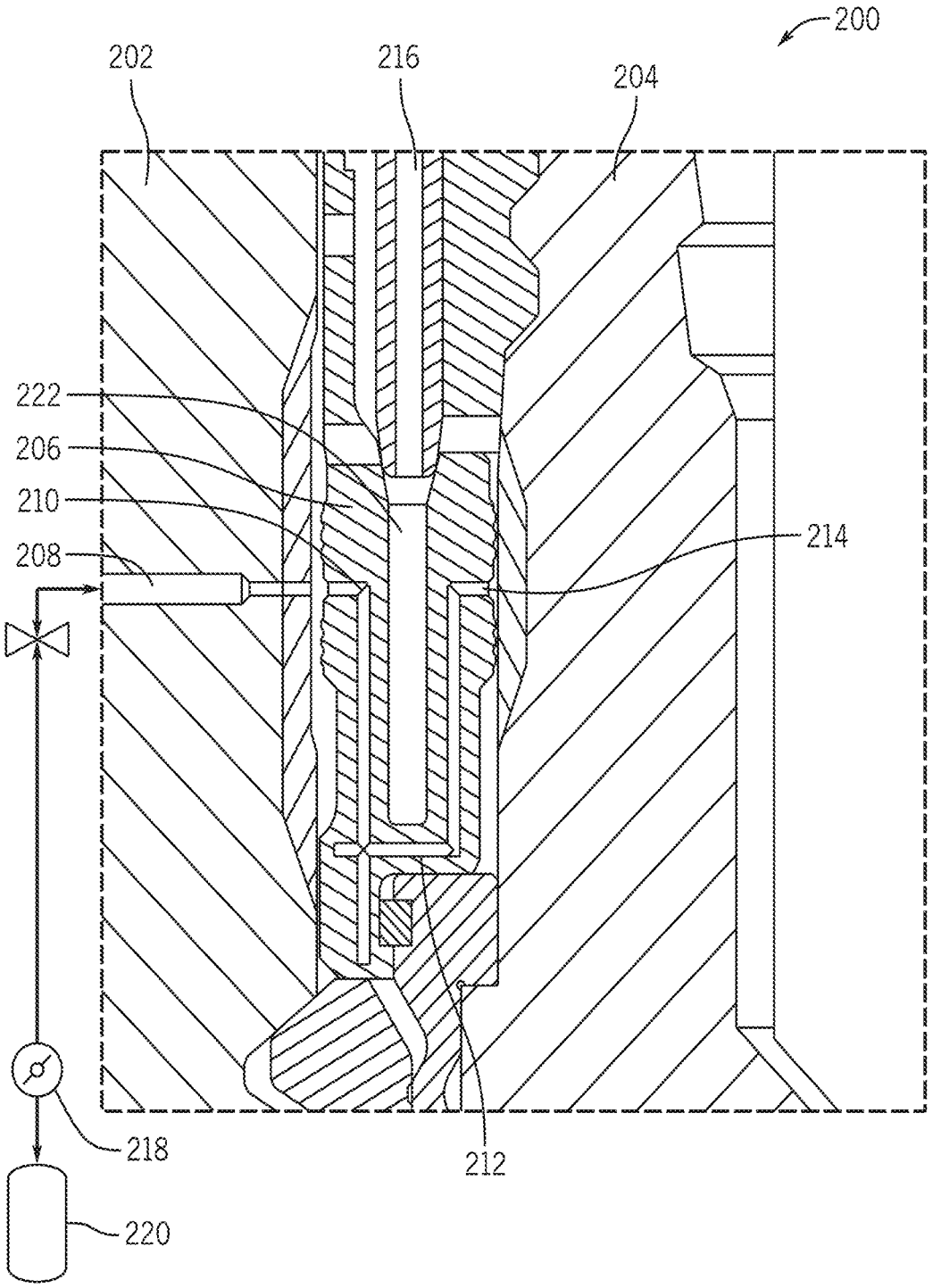
FIGS. 2A, 2B, and 2C illustrate examples of ported U-cups in various usages in accordance with aspects of this disclosure.
Figure 2B:
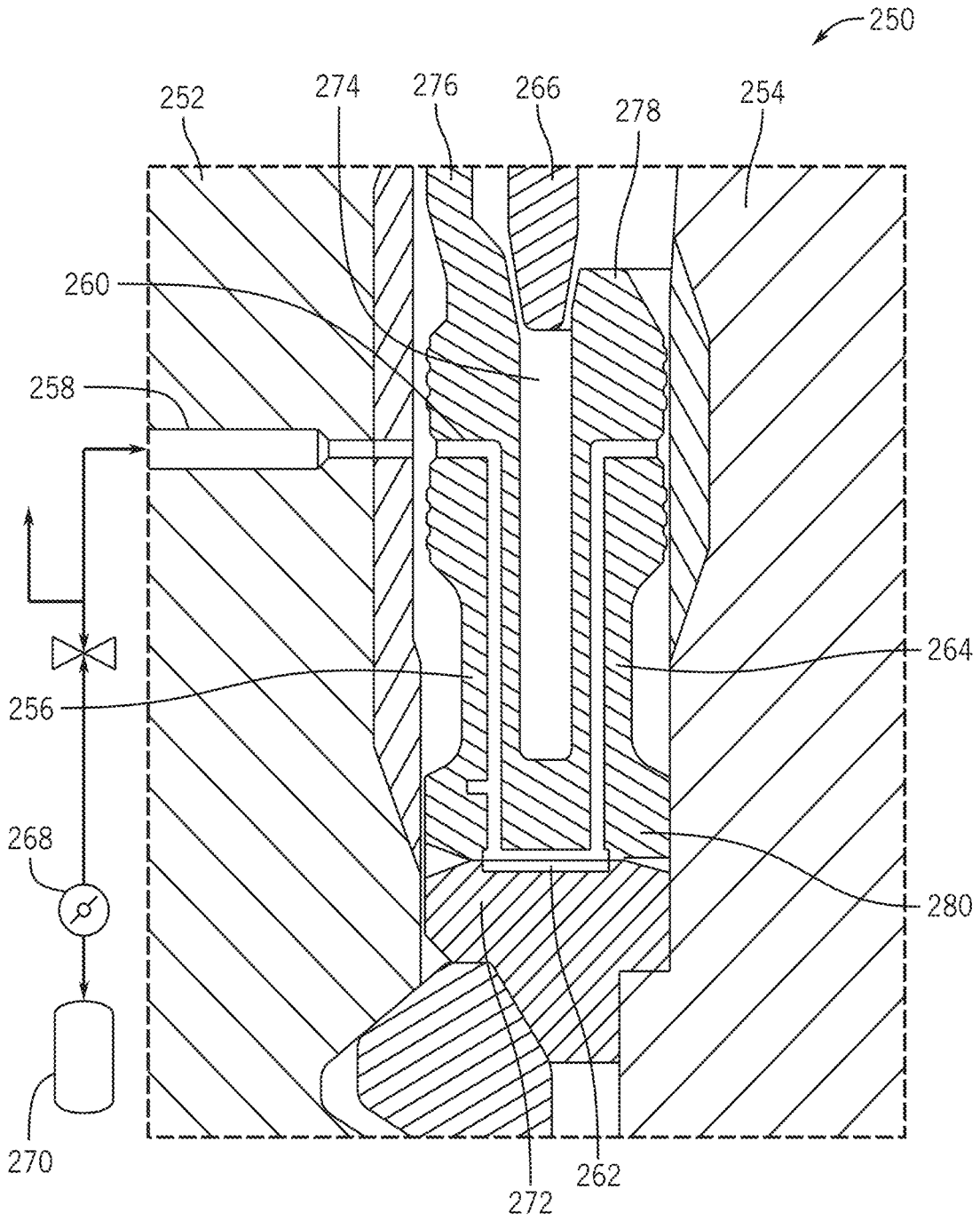
Figure 2C:
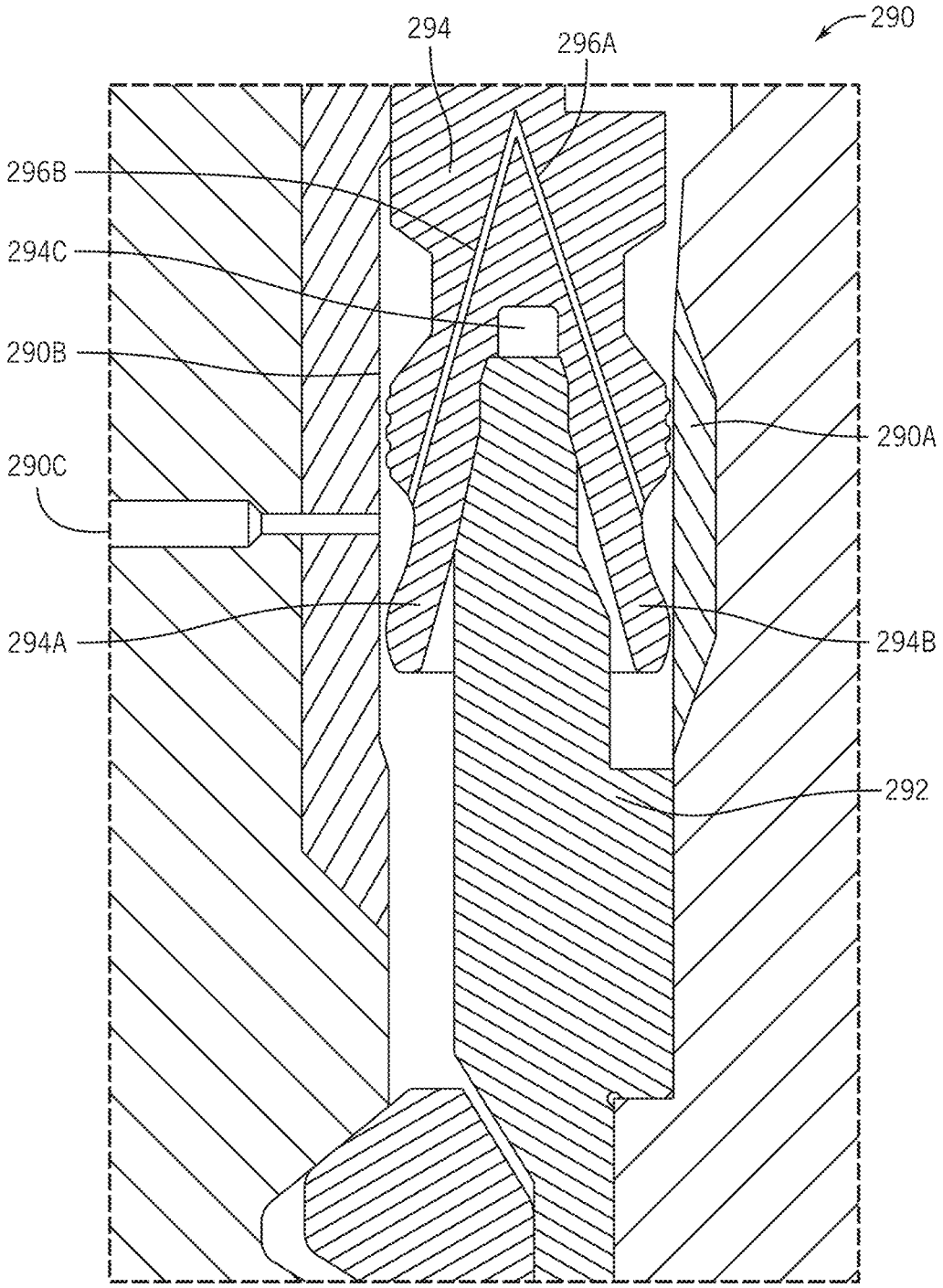

FIGS. 2A, 2B, and 2C illustrate examples 200, 250, 290 of ported U-cups in various usages in accordance with aspects of this disclosure. Ported U-cup 200 may represent an exploded cross sectional side view of the area between the casing hanger 114 and the housing of the wellhead 112. In FIG. 2A, the housing of the wellhead is represented by reference numeral 202 and the hanger, by reference numeral 204. The port 208 is available through the housing 202 for external access, testing, and monitoring. FIG. 2A illustrates ported U-cup 206 that may be energized by an energizing ring (e-ring) 216 that is provided to be pushed into place with the ported U-cup 206. In an implementation, applied force and materials may be removed once the ported U-cup 206 is in place. Further, when energized (e.g., pressed into position in the U-cup), the e-ring 216 causes the outer seal bands for the ported U-cup 206 to press against the housing 202 on one side and the hanger 204 on the other side, thereby providing high temperature and high pressure seals in four different locations as illustrated in FIGS. 2A, 2B, and as further illustrated in FIG. 4.

FIG. 2A also illustrates that grooves or ports 210 may be formed in the ported U-cup 206 so that they traverse sections of the U-cup material and circumvent a U-cup space 222. A person of ordinary skill would recognize that a port may be an opening or may extend laterally into a material. The person of ordinary skill would recognize the distinction between grooves, ports, and/or enclosed space 210 that extends through the material of the seal on the one hand and the port 208 that is an opening to the grooves, the ports, and enclosed space 210. The traversing of the material and circumventing of space 222 ensures that integrity tests may be conducted for the seal in-place and without structural modifications that may damage the seal by penetrating through the U-cup space 222. In an example, the grooves or ports may be an enclosed space through a first section of the ported U-cup 206 (e.g., path 210) traversing a middle section of the ported U-cup 206 (e.g., path 212), and to a second section of the ported U-cup 206 (e.g., path 214). As such, the entire groove, port or enclosed space is treated as a single smooth path from the first section, through the middle section, and to the second section. While illustrated with gaps at corners in the paths in FIG. 2A, a person of ordinary skill would recognize upon reading this disclosure that the path may not include any gaps and may include smooth transition at the corners. Further, the paths may be formed by a drill application at the first section (represented as the lip of the ported U-cup 206 and marked by path 210), at the middle portion (represented the bottom of the ported U-cup 206 and marked by path 212), and at the second portion (represented by the second lip of the ported U-cup 206 and marked by path 214).

In an aspect, the holes are drilled so that path 210 intersects path 212, and so that path 212 intersects path 214, the holes to the outside of the ported U-cup 206 are sealed at the intersections, leaving open the drill hole to port 208 on the first section and drill hole at the end of path 214 in the second section. These paths or ported paths may alternatively be created by, but not limited to, one or more of the following methods: drilling/Electrical Discharge Machining (EDMing) holes with sealing (e.g., welding, intersecting, blocking, etc.), 3D printing, powder sintering, and casting. Further, machining methods may apply means to seal certain portions of the internal porting by weld or plugs once the holes are created. A person of ordinary skill would recognize that the sealing is provided for ensuring that the enclosed space is integral within the seal (and any supporting element, the housing, and the hanger) and that methods for sealing otherwise not listed but to achieve the same end result of the present enclosed space is within the bounds of this disclosure or the interpretation associated with the example sealing methods provided. As a result of the above process, no changes to the installation and operation of a seal is visible to the end-user and the U-cup, as used, is fully transparent to the end-user. Further, there is no requirement for additional parts in the seal assembly.

In an alternate implementation, illustrated in FIG. 2B, a modification to the ported U-cup from FIG. 2A is such that a portion of the porting is provided from a neighboring element that is sealed against the ported U-cup. In this case, as in the case of the U-cup in example 200, the U-cup of example 250 includes ports or enclosed spaces that traverse sections 276, 278 of the U-cup material and that circumvent a U-cup space 274. In a similar reasoning as to U-cup example 200, this embodiment ensures that integrity tests may be conducted for the seal in-place and without structural modifications that may damage the seal by penetrating through the U-cup space 274. For example, FIG. 2B illustrates a system 250 with the use of a ported U-cup 256 that includes two enclosed paths (enclosed by the ported U-cup) and a third open path that is enclosed by another element in the sealing elements of the wellhead. In the example of FIG. 2B, a part of the enclosure to path 262 is offered from a lock ring energizer support 272 when the lock ring energizer or energizer element 266 is fully in place to energize the seal 256. This process reduces the machining required to create the ports in the ported U-cup 256. As a result, in contrast to the implementation of FIG. 2A, the implementation of FIG. 2B may be formed by a drill application at the first section (represented as the lip of the ported U-cup 256 and marked by path 260) and at the second portion (represented by the second lip of the ported U-cup 256 and marked by path 264). Further, the middle portion is provided partly by either a drilling or shaping of the bottom part of the U-cup 256, and partly by a similar process of drilling or shaping of the top of the neighboring element—e.g., lock ring energizer support 272. Alternatively, no machining is done to the bottom of the ported U-cup 256 or the top of the neighboring element. Instead, the entire space there between is used to guide any fluid for measurement of integrity of formed seals using the ported U-cup 256.

The porting 208, 258 and paths 210, 212, and 214 (or 260, 262, and 264) enable testing and monitoring of the above-referenced high temperature and high pressure seals. For example, a fluid of any applicable type—determined by the type of monitoring and conditions being monitored—may be applied to the port 208, 258 (through housing 202, 252). The fluid may include liquid or gaseous state fluids, and may be applied to test the integrity of an applied seal, but may also be applied at subsequent times, during or intervening with the usage of the wellbore. The fluid pressure can be monitored and when outside a predetermined range, could be taken to indicate a failure of the seals or an issue of sorts with the seals from the ported U-cup 256. Further, in this active monitoring process, a chemical detection for leaks may also be used alternatively or with the pressure monitoring. The chemical detection may be similar to the discussion of passive monitoring subsequently in this disclosure. The chemical detection may rely on a sensor to detect presence of certain well-formation chemicals, including and without limitation, hydrogen, methane, compounds of sulfur, etc. When such chemicals migrate through the seal against the housing or the hanger, detection of one or more of such chemicals may be relied upon as an indication of loss of the seal's integrity. As such, a pressure monitoring is not applied in an embodiment using chemical monitoring, but both may exist together in a system for redundancy or verification purposes. The lock ring energizer must therefore be sealed against the U-cup 256 by means including but not limited to welding, brazing, diffusion bonding, threads, or a separate sealing mechanism.

FIG. 2C provides yet another example 290 of a ported U-cup seal 294 in an inverted configuration with a lock ring energizer element 292 to energize the seal 294. In this case, as in the cases of the U-cup of FIGS. 2A and 2B, the U-cup 294 of example 290 includes ports or enclosed spaces 296A, 296B that traverse sections 294A, 294B of the U-cup material and that circumvent a U-cup space 294C. In a similar reasoning as to the U-cup of example 200, this embodiment ensures that integrity tests may be conducted for the seal in-place and without structural modifications that may damage the seal by penetrating through the U-cup space 294C. This example may rely on an element functioning as both the energizer ring element and support 292 to energize the seal 294. The seal 294, in operation, seals against a housing 290B on one side and against a hanger 290A on the other side, similar to the examples of FIGS. 3A, 3B. Further, a port 290C is available to access the enclosed space through the housing and to the hanger. In addition, the example of FIG. 2C eliminates a need for sealing as the drilled ports or enclosed spaces are intersecting to enable traversing the enclosed space from the port 290C through the hanger 290A, and do not extend past the material of the seal 294.

At least two modes of operation are provided in the present disclosure—one for testing and one for monitoring. In the testing mode, a fluid is applied under pressure and the pressure is increased steadily and held. A significant pressure drop during the testing mode, of the monitored pressure, indicates a breaching of predetermined ranges for the test, a failure of the seals. Further, the above-reference pressure may be isolated from the pressure source, and may be held for a short period of time—e.g., several seconds or minutes—before being allowed back to ambient pressure. When the pressure remains as applied for the short period of time, then the pressure test is successful. The testing mode may be applied periodically—e.g., within a cycle of a predetermined number of months.

In the monitoring mode, the pressure in the port is measured at predetermined time intervals without application of a fluid—in contrast to the testing mode. In an example, the port may include existing fluid and the ambient pressure is checked. A gauge for the monitored pressure determines the pressure for an extended period of time (e.g., for years) and may record pressure every few minutes (e.g., 5 minutes). When there are no changes in the pressure over a predetermined value or range, then the seal is considered to be normal and working. When there is a change over the predetermined value or range, then it may be determined that the seal is leaking from the bore or the annulus. As such, by measuring the pressure at the port, an alert may be provided when the pressure experiences any changes outside the predetermined value or a predetermined range. For example, if a significant increase in pressure (e.g., above a predetermined value or range) occurs, this would imply a problem exists, otherwise there are no issues identified. One difference between the monitoring and testing modes is that the monitoring mode provides an indication that a problem does or does not presently exist, while testing ensures that the seal will work at full wellbore pressure. In another example, a calibration mode may also exist to initially rate the seal for the application or the wellhead. The calibration may partly rely on the testing mode, which is applied to different wellheads or configurations to rate the seal for the type of wellhead.

As such, the integrity of the seal during installation may be determined by application of fluid under pressure to ensure that pressure rises within predetermined ranges for existing types of wellbores. For example, when applied in practice, a seal (as described herein with the ported paths) and housing structure of a particular location may be required to always have a particular pressure range that is deemed acceptable—within a predetermined range. When a measured fluid pressure is outside of such a predetermined pressure range of the seal and housing structure of that location (e.g., a sudden or extended change in pressure of the fluid within ported paths), the integrity of the seal may be not be acceptable for the application because the change in pressure may be an indication of fluid leak from the seal, that the seal has gaps, and that the seal is not functioning as intended. Appropriate corrections may be performed or the system may not be allowed to enter service. Under the monitoring mode, pressure in the port—under 0 psi or ambient pressure (may still be referred to as "under pressure")—is gauged to see if the seals holds that pressure value or holds the pressure within a range of the 0 psi pressure (allowing for thermal expansion, for instance).

The port 208, 258 connects to the enclosed ports or paths from one side or section of the U-cup 206, 256 (or any applicable seal) to the other side or section of the U-cup 206, 256. This is such that the above-referenced fluid may be provided through the port, through the enclosed ports or paths (or the available space between the bottom port opening and the top of a sealed neighboring element) to each of the four seals illustrated in FIGS. 2A, 2B, and 4. The hold of the seals against the housing 202, 252 on one side and the hanger 204, 254 on the other side demonstrates good function and structural integrity if the pressure measure—for the applied fluid—holds within predetermined ranges of pressure. For example, minute variations may be ignored, but large or sudden changes may be indicative of failure—either presently in the seals or imminent due to movement, loads, stresses, or temperature. For example, due to the temperature variations, the pressure may change, but the predetermined range takes such changes into consideration and only registers an issue outside of the predetermined ranges. In an example, the port 208, 258 is monitored by an alarm connected to an applied pressure meter through which the fluid is being applied. As such, the alarm may sound when the predetermined ranges are breached. Furthermore, the integrity of the seals may be determined also by the pressure being within predetermined ranges for existing types of wellbores. For example, once applied and studied at one location, a ported seal and housing structure of that location may be required to always have a particular pressure range that is deemed acceptable—within a predetermined range. When a measured fluid pressure is outside of such a predetermined pressure range of the ported seal and housing structure of the particular location, the integrity may be acceptable to holding the seal, but may be an indication that the structure has changed somewhere within the housing, the hanger, or the seal. Appropriate corrections may be performed or the system may be allowed to function till the next service is due.

Figure 3:
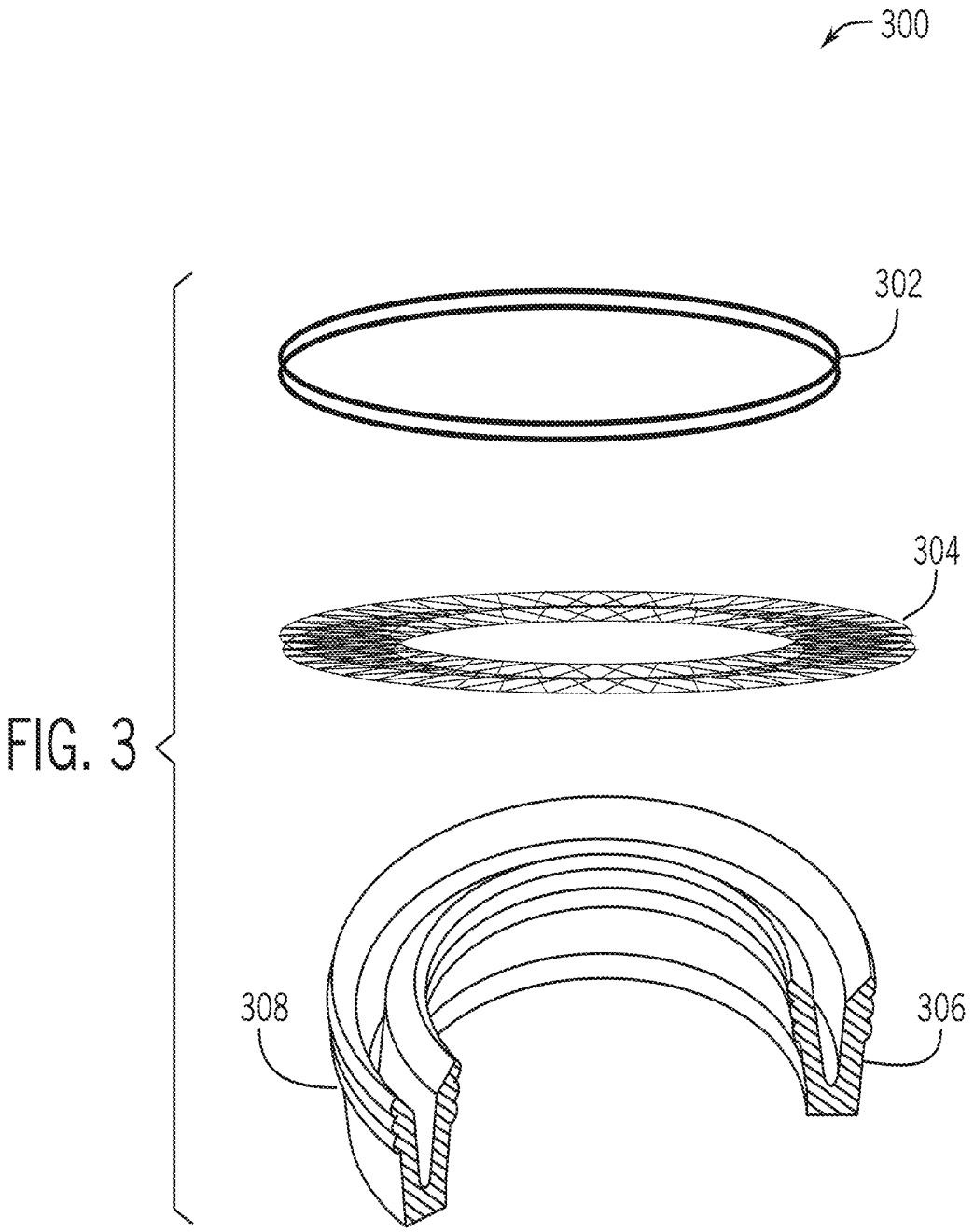
FIG. 3 illustrates an example seal provided with energizing elements in accordance with another aspect of this disclosure.

FIG. 3 illustrates example seals and related energizing elements 300 in accordance with another aspect of this disclosure. The wellhead annulus seal, such as a U-cup 306, may be applicable for the present implementation and may be applied in subsea as well as in surface applications. The seal 306 may be tested via a port in the side of the housing as illustrated in FIG. 2. FIG. 3 also illustrates external and internal seal bands or ribs 308 for allowing higher temperature and high pressure sealing against the hanger of the wellhead on the internal seal bands or ribs, and to the housing of the wellhead on the external seals bands or ribs (e.g., at the top outside portions of the seal 306). A first section of the seal and a second section of the seal have separations forming a first portion and a second portion for each of the first section and the second section of the seal so that there are four locations of the seal pressing against the housing when the seal is energized. As such, when reference is made to the first seal or the second seal against one of the housing and the hanger, a person of ordinary skill would recognize that the sealing or holding of the seal bands or ribs (of the first seal or the second seal) is being discussed in this context unless explicitly stated otherwise. In the example in FIG. 3, the seal 306 may be a metal-to-metal (MS) seal forming a U-cup structure and an energizing ring or e-ring 302, 304 applied to the U-cup structure to place the seal in the hanger. E-rings 302, 304 may be helical springs (elliptical coil springs), helical wound springs, v-springs (cantilever springs), and/or continuous contact springs. The wellhead may require multiple such U-cups of different internal diameters as to the drill pipe narrows The porting or enclosed paths in the U-cup is left open to permit hydraulic communication from the housing to the casing hanger. A testing of the annulus seal is accomplished by application of pressure (e.g., through a fluid) into the port in the housing—illustrated in FIGS. 2A and 2B. The application of pressure may be by a pressurized source or applicator (e.g., reference numeral 218, 268 in FIGS. 2A, 2B), such as a tank of fluid under pressure asserted from an inert gas, or may be a gas under pressure in the tank. In an example, chemical detection may be performed instead of a fluid under pressure. A chemical detection may be by the expression of well-formation gases into the path between upper and lower seals. The detection of the gases in areas outside the path may be used to determine integrity of the seal for testing and monitoring. The port provides access to the seal interfaces on the U-cup 306, and through a path of communication from the housing to the casing hanger (e.g., the path is formed by the enclosed paths as in FIG. 2A or from the junction of neighboring elements from when the U-cup 256 is positioned against the neighboring element 272 in FIG. 2B).

Figure 4:
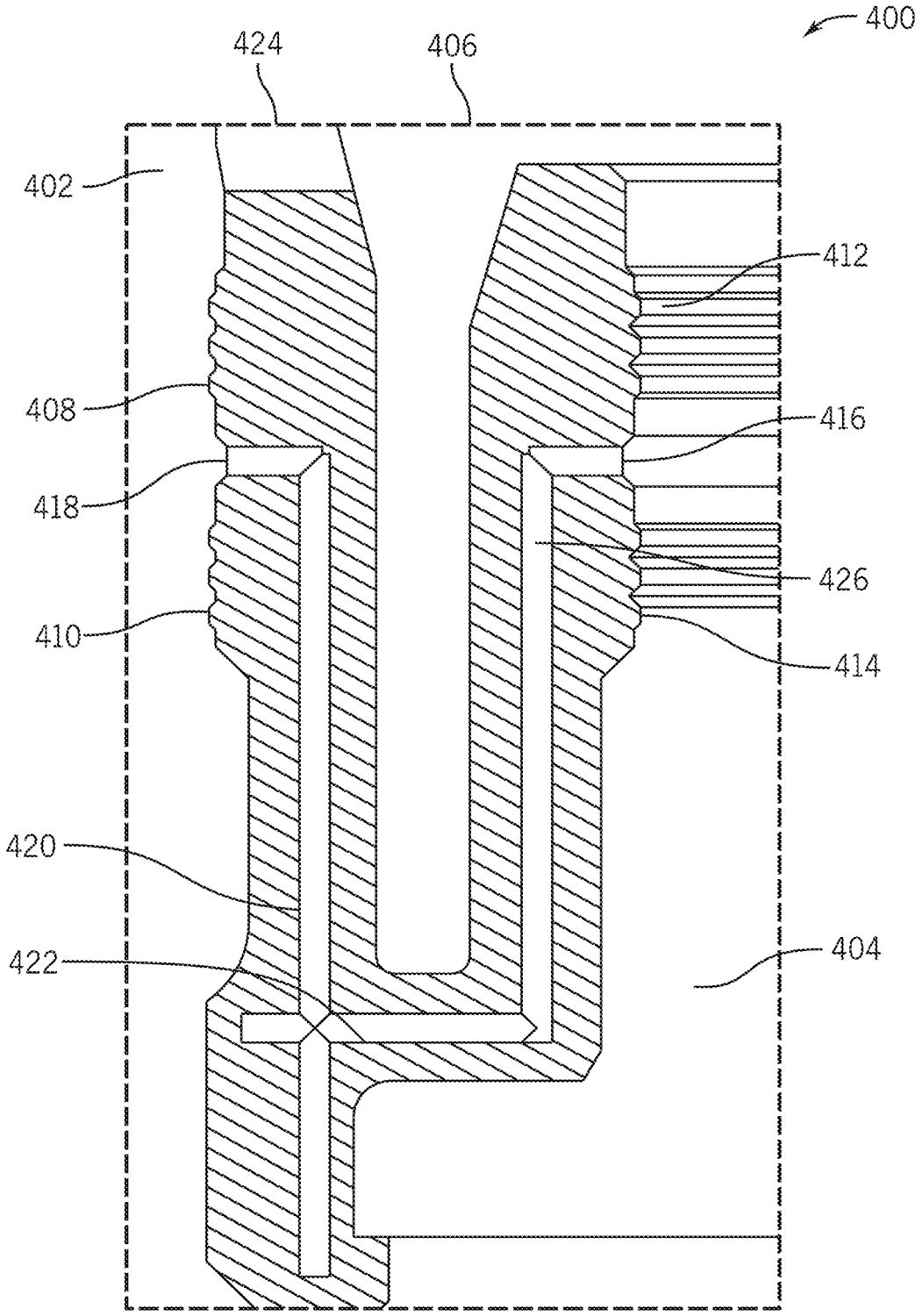
FIG. 4 illustrates further details of one type of ported U-cup in accordance with various embodiments of this disclosure.

FIG. 4 illustrates further details 400 of the ported U-cup of FIG. 2A in accordance with various embodiments of this disclosure. The details in FIG. 4 illustrates that the present implementation eliminates a need for holes to be cut into the e-ring 406 to create a path of communication from the housing side to the hanger side. The ported U-cup provides sealing interfaces of the four hanger and housing seals 408, 410, 412, and 414 to seal the bore and annulus, but they do not seal between each other. For example, they create a third, in-between area or volume 416 that is hydraulically connecting the housing to the hanger. This in-between area or volume 416 is accessed by the port provided for testing and monitoring in the housing. The use of pressurized fluid applied to the port transfers to this area or volume 416 and allows testing of all four hanger and housing seals 408, 410, 412, and 414. A gauge (e.g., gauge 220, 270 in FIGS. 2A and 2B) may be applied in the line providing the fluid under pressure to check if the pressure remains within predetermined ranges once the area or volume is saturated. The ported U-cup 424 is, in one implementation, a single piece with an internal ported path that provides hydraulic communication between the housing and casing hanger. The u-cup has seal interfaces to the housing and casing hanger above and below the ported path which isolates the path from both the bore (above) and the annulus (below). Testing of the annulus seal is accomplished by pressurizing through the above-referenced port, between the seal interfaces above and below, and through the path of communication to the casing hanger. Further, in an aspect of the disclosure, the ported U-cup 424 may be formed of a corrosion resistant alloy (CRA) or other material that embodies the material and functional features expressed throughout this disclosure. The CRA may be a special alloy seal, stainless steel, or nickel alloy capable of high pressure and high temperature metal-to-metal sealing. This ported U-cup could also be made of low allow steel or similar metallic material.

Figure 5A:
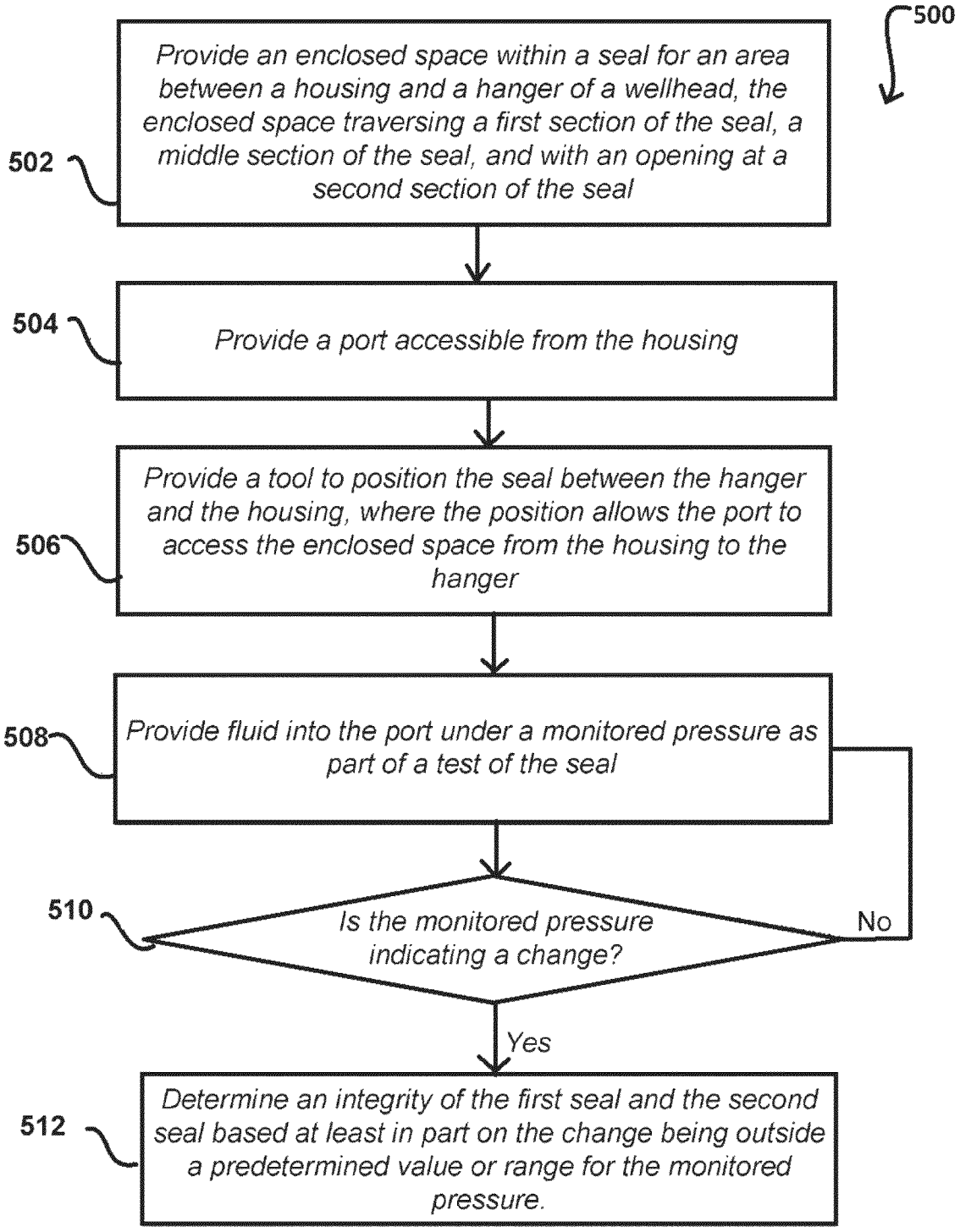
FIGS. 5A and 5B illustrate example process flows using seals that may be ported U-cups in accordance with aspects herein.

FIG. 5A illustrates an example process flow 500 using seals that may be ported U-cups in accordance with aspects herein. The application of process flow 500 provides a path of communication (for monitoring and testing of pressure and integrity of seals) between the housing and casing hanger while still sealing the bore above and the annulus below. The process flow 500 and the structures of FIGS. 2-4 illustrate an application that does not require holes through the seal U-cup and e-ring to provide such a communication for monitoring and testing. The holes previously introduced requirements for additional seal interfaces and, therefore, for potential leak paths and increased risk of structural failure that the present implementation eliminates. The present implementation relies instead on limited seal interfaces formed between the e-ring and the U-cup and pathways there between (e.g., the ported paths or the paths from the junction of neighboring elements—as in reference numeral 262 of FIG. 2B) instead of the holes.

In the example process 500, sub-process 502 provides an enclosed space within a seal. As discussed above, the enclosed space may be a ported path provided by a drill with seals (e.g., welding) to close the drill holes except for the holes on either lip of the ported U-cup, or the holes may be partly closed by the ported paths and partly by a junction caused by a neighboring element to the ported U-cup. The enclosed space traverses a first section of the seal (e.g., first lip of the U-cup), a middle section of the seal (e.g., the middle section of the U-cup), and provides an opening at a second section of the seal (e.g., the second lip of the U-cup). Sub-process 504 provides a port to the enclosed space and to be accessible from the housing. Sub-process 506 provides a tool to position the seal within a hanger and a housing of the wellhead. This will create the path from the wellhead port to the hanger. For example, sub-process 506 provides a running tool or other tool to energize the seal by driving the energizing ring into the U-cup.

Sub-process 508 provides fluid into the port under a monitored pressure for testing the seals of a U-cup against the hanger and against the housing. As process 500 reflects a testing mode, the monitored pressure reflects the elevated pressure (e.g., constantly increasing pressure) that is stopped at a predetermined pressure value and held for a period of time. For example, sub-process 508 provides elevated pressure to the port, isolated from the source pressure, and maintains the elevated pressure at a peak for a predetermined period of time. In sub-process 510, a check occurs as to whether the monitored pressure indicates a change. In an example, when sub-process 508 provides fluid, the monitored pressure may be higher than a failure pressure for the seal or may be outside a rated pressure for the seal. When the monitored pressure steadily climbs and the seal holds, sub-process 512 determines that the seal is functioning properly. Thereafter, the sub-process 508 may continue the test with higher pressures till saturation is obtained—which may also indicate good integrity of the seals—or may stop the testing if the process 500 is applied for testing at a rated pressure or pressure range. When a change, such as a spike, in the monitored pressure is detected in sub-process 510, sub-process 512 commences to determine that the integrity of the seals against the housing and/or against the hanger may have failed. As such, the sub-process 512 determines the integrity based at least in part on the change of the monitored pressure being within predetermined ranges for the monitored pressure. A spike or change of the monitored pressure may indicate a failure and the seals (e.g., the ported U-cup) are not allowed into service.

Figure 5B:
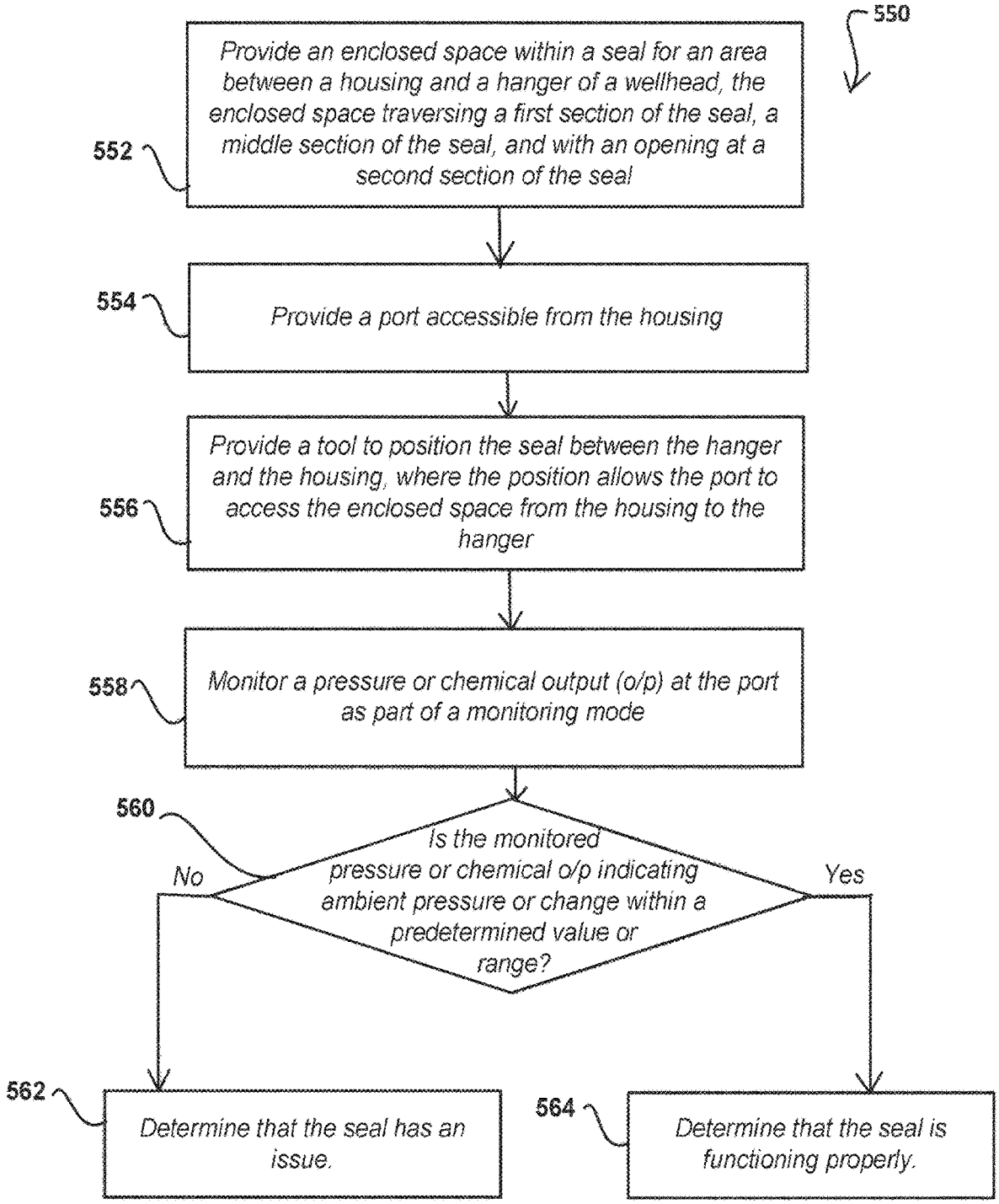

FIG. 5B illustrates an example process flow 550 using seals that may be ported U-cups in accordance with aspects herein. The example process flow 550 may be a monitoring mode for the seals. In the example process 550, sub-process 552 provides an enclosed space within a seal. As discussed above, the enclosed space may be a ported path provided by a drill with seals (e.g., welding) to close the drill holes except for the holes on either lip of the ported U-cup, or the holes may be partly closed by the ported paths and partly by a junction caused by a neighboring element to the ported U-cup. The enclosed space traverses a first section of the seal (e.g., first lip of the U-cup), a middle section of the seal (e.g., the middle section of the U-cup), and provides an opening at a second section of the seal (e.g., the second lip of the U-cup). Sub-process 554 provides a port to the enclosed space and to be accessible from the housing. Sub-process 556 provides a tool to position the seal within a hanger and a housing of the wellhead. This will create the path from the wellhead port to the hanger. For example, sub-process 556 provides a running tool or other tool to energize the seal by driving the energizing ring into the U-cup.

Sub-process 558 monitors a pressure or chemical output (e.g., leak) at the port as part of the monitoring mode. In an example, the monitored pressure is 0 psi or ambient pressure. In sub-process 560 a check occurs as to whether the monitored pressure indicates a change outside a predetermined value or range. In an example, when the sub-process 558 gauges the monitored pressure to determine that it remains at 0 psi or ambient pressure. As previously described, a chemical output monitoring process may, alternatively or concurrently, be used to monitor for leaks as part of the monitoring mode. The chemical output monitoring may be a chemical detection using a sensor to detect presence of certain well-formation chemicals, including and without limitation, hydrogen, methane, compounds of sulfur, etc. When such chemicals migrate through the seal against the housing or the hanger, detection of one or more of such chemicals may be relied upon as an indication of loss of the seal's integrity. As such, a pressure monitoring is not applied in an embodiment using chemical monitoring, but both may exist together in a system for redundancy or verification purposes.

In sub-process 560, the determination of changes to the monitored pressure or chemical output indicating a leak may be by monitoring an ambient pressure or 0 psi (or a change within a predetermined value or range—e.g., considering thermal expansion) or by detecting for the well-formation chemicals. Such determination may be used to indicate that the seal is functioning properly (or is compromised) via sub-process 564. The sub-process 558 may continue its monitoring or may be stopped. Alternatively, the process 552 may be stopped if the process 550 is being applied within a time period, instead of as continuous monitoring over a lifetime of the seal. When an exceptional (e.g., substantial) change in the monitored pressure is detected in the gauge (e.g., as being outside of ambient pressure, 0 psi, or the predetermined value range), via sub-process 560, sub-process 562 commences to determine that the seal has an issue either against the housing and/or against the hanger. In an example using the chemical detection method, an appropriate gas (e.g., compounds of sulfur) is provided under ambient pressure conditions suitable to the flow of the gas and to the system including the seals. Then a gas or chemical detector may be used to detect the gas in locations outside the ported path, for instance. Such detection indicates an issue in the seal.

Furthermore, the monitored pressure may be provided to equipment in module 100 of FIG. 1 for transmission to remote receiving stations. In an example, such remote receiving stations are web-based, as relate to web services and cloud computing, but it should be appreciated that, although a web-based environment is used for purposes of explanation, different environments may be used, as appropriate, to implement various embodiments. Client devices may then connect to the web-based services to interact with the data received and to remotely control or determine a responsive action to the change in monitored pressure.

Alternate embodiments may rely on alarms that send and receive requests, messages, or information over an appropriate network and convey information back to a user of the device. Examples of such client devices include personal computers, smart phones, handheld messaging devices, laptop computers, set-top boxes, personal data assistants, electronic book readers, and the like. The network can include any appropriate network, including an intranet, the Internet, a cellular network, a local area network, or any other such network or combination thereof. Components used for such a system can depend at least in part upon the type of network and/or environment selected. Protocols and components for communicating via such a network are well known and will not be discussed herein in detail. Communication over the network can be enabled by wired or wireless connections, and combinations thereof using a communication component.

It should be understood that there can be several application servers, layers, or other elements, processes, or components, which may be chained or otherwise configured, which can interact to perform tasks as discussed and suggested herein. As used herein the term "data store" refers to any device or combination of devices capable of storing, accessing, and retrieving data, which may include any combination and number of data servers, databases, data storage devices, and data storage media, in any standard, distributed, or clustered environment. At least one of the application servers can include any appropriate hardware and software for integrating with the data store as needed to execute aspects of one or more applications for the client device, handling a majority of the data access and business logic for an application. The application server provides access control services in cooperation with the data store, and is able to generate content such as text, graphics, audio, and/or video to be transferred to the user, which may be served to the user by the Web server in the form of HTML, XML, or another appropriate structured language in this example. The handling of all requests and responses, as well as the delivery of content between a client device and a resource, can be handled by the Web server. It should be understood that the Web and application servers are not required and are merely example components, as structured code discussed herein can be executed on any appropriate device or host machine as discussed elsewhere herein.

A data store can include several separate data tables, databases, or other data storage mechanisms and media for storing data relating to a particular aspect. The data store is operable, through logic associated therewith, to receive instructions from a server, and obtain, update, or otherwise process data in response thereto. In one example, a user might submit a search request for a certain type of item. In this case, the data store might access the user information to verify the identity of the user, and can access the catalog detail information to obtain information about items of that type. The information then can be returned to the user, such as in a results listing on a Web page that the user is able to view via a browser on the user device. Information for a particular item of interest can be viewed in a dedicated page or window of the browser.

Each server will include an operating system that provides executable program instructions for the general administration and operation of that server, and will include a non-transitory computer-readable medium storing instructions that, when executed by a processor of the server, allow the server to perform its intended functions. Suitable implementations for the operating system and functionality of the servers are known or commercially available, and are readily implemented by persons having ordinary skill in the art, particularly in light of the disclosure herein.

The environment in one embodiment is a distributed computing environment utilizing several computer systems and components that are interconnected via communication links, using one or more computer networks or direct connections. However, it will be appreciated by those of ordinary skill in the art that such a system could operate equally well in a system having fewer or a greater number of components than are described. Thus, the depictions of various systems and services herein should be taken as being illustrative in nature, and not limiting to the scope of the disclosure.

Various aspects can be implemented as part of at least one service or web service, such as may be part of a service-oriented architecture. Services such as web services can communicate using any appropriate type of messaging, such as by using messages in extensible markup language (XML) format and exchanged using an appropriate protocol such as SOAP (derived from the "Simple Object Access Protocol"). Processes provided or executed by such services can be written in any appropriate language, such as the Web Services Description Language (WSDL). Using a language such as WSDL allows for functionality such as the automated generation of client-side code in various SOAP frameworks.

Most embodiments utilize at least one network that would be familiar to those skilled in the art for supporting communications using any of a variety of commercially-available protocols, such as TCP/IP, FTP, UPnP, NFS, and CIFS. The network can be, for example, a local area network, a wide-area network, a virtual private network, the Internet, an intranet, an extranet, a public switched telephone network, an infrared network, a wireless network, and any combination thereof.

In embodiments utilizing a Web server, the Web server can run any of a variety of server or mid-tier applications, including HTTP servers, FTP servers, CGI servers, data servers, Java servers, and business application servers. The server(s) may also be capable of executing programs or scripts in response requests from user devices, such as by executing one or more Web applications that may be implemented as one or more scripts or programs written in any programming language, such as Java®, C, C # or C++, or any scripting language, such as Perl, Python®, or Tool Command Language (TCL), as well as combinations thereof. The server(s) may also include database servers, including without limitation those commercially available from Oracle®, Microsoft®, Sybase®, and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices can also include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices will also include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and other non-transitory computer readable media for containing code, or portions of code, can include any appropriate media known or used in the art, including storage media and communication media, such as but not limited to volatile and non-volatile, removable and non-removable media implemented in any method or technology for storage of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the invention as set forth in the claims.

Example clauses: (1) In an implementation, a system is disclosed comprising: an enclosed space within a seal for an area between a housing and a hanger of a wellhead, the enclosed space traversing a first section of the seal, a middle section of the seal, and an opening at a second section of the seal; a port accessible from the housing; a tool positioning the seal between the hanger and the housing, and allowing access between the port and the enclosed space; a pressure applicator applying fluid into the port at a pressure; and a pressure gauge monitoring the pressure of the fluid to determine integrity of the seal against one of the housing and the hanger, by the pressure falling within predetermined ranges. (2) In another implementation, a method is disclosed comprising: providing an enclosed space within a seal for an area between a housing and a hanger of a wellhead, the enclosed space traversing a first section of the seal, a middle section of the seal, and with an opening at a second section of the seal; providing a port accessible from the housing; providing a tool to position the seal between the hanger and the housing, and allowing access between the port and the enclosed space; providing fluid into the port under a monitored pressure; and determining integrity of at least one of the first seal and the seconds seal against one of the housing and the hanger, when the monitored pressure falls outside one or more predetermined ranges. (3) In another implementation, a method is disclosed comprising: providing an enclosed space within a seal for an area between a housing and a hanger of a wellhead, the enclosed space traversing a first section of the seal, a middle section of the seal, and with an opening at a second section of the seal; providing a port accessible from the housing; providing a tool to position the seal between the hanger and the housing, and allowing access between the port and the enclosed space; monitoring a pressure at the port; and determining that an issue exists for at least one of the first seal and the seconds seal against one of the housing and the hanger, when the monitored pressure falls outside one or more predetermined values or ranges—such as 0 psi or an ambient pressure, or a range which may include 0 psi or the ambient pressure with consideration to thermal expansion.

What is claimed is:

1. A system comprising:

a seal for an area between a housing and a hanger of a wellhead, the seal having an enclosed space that vertically or diagonally traverses through a first section and a through second section of the seal, and that circumvents a U-cup space provided for energizing the seal; and a port accessible from the housing to the enclosed space.

2. The system of claim 1, further comprising:

a pressure applicator for applying fluid into the port at a pressure; and a pressure gauge for monitoring the pressure of the fluid to determine integrity of the seal against one of the housing and the hanger, by the pressure falling within predetermined ranges.

3. The system of claim 1, further comprising:

an energizing ring for filling the U-cup space to energize the seal for normal operation by causing the first section of the seal to press against the housing and for causing the second section of the seal to press against the hanger.

4. The system of claim 1, wherein an energizing ring for the energizing of the seal is one of: helical springs or elliptical coil springs, helical wound springs, v-springs or cantilever springs, and continuous contact springs.

5. The system of claim 1, wherein the seal is formed of a metal alloy material comprising one or more of: an alloy of steal, stainless steel, and a nickel alloy.

6. The system of claim 1, wherein the enclosed space within the seal is formed of connected drill holes in each of the first section and the second section, and allows the circumvention of the U-cup space.

7. The system of claim 1, wherein the first section of the seal and the second section of the seal comprise separations forming a first portion and a second portion for each of the first section and the second section of the seal so that there are four locations of the seal pressing against the housing when the seal is energized.

8. The system of claim 1, wherein the enclosed space within the seal is formed by one or more of: Electrical Discharge Machining (EDMing), 3-Dimensional (3D) printing, powder sintering, and casting.

9. The system of claim 1, further comprising:

a middle section of the seal that is machined and left open to form at least a channel between a bottom of the seal and a lock ring energizer element, the channel forming part of the enclosed space in the seal.

10. The system of claim 1, further comprising:

an alarm connected to a gauge for monitoring a pressure of fluid applied to the enclosed space so that a change in an expected pressure range triggers the alarm.

11. A method for enabling integrity testing of a seal against a housing and a hanger of a wellhead comprising:

providing an enclosed space within the seal for an area between the housing and the hanger of the wellhead, the enclosed space vertically or diagonally traversing through a first section and through a second section of the seal, having an opening for a port at the second section of the seal, and circumventing a space provided for energizing the seal; and providing a port that is accessible from the housing to receive fluid to the enclosed space and to monitor the fluid for integrity of the seal.

12. The method of claim 11, further comprising:

monitoring a pressure of the fluid when it is applied to the port, the pressure applied increasingly from a lower value to a higher value of a range of pressure values; and determining integrity of the seal against one of the housing and the hanger as the pressure is applied increasingly.

13. The method of claim 11, further comprising:

providing a tool to position the seal between the hanger and the housing;

applying the fluid to the enclosed space via the port; and determining that an issue exists for the seal against one of the housing and the hanger when a pressure of the fluid falls outside one or more predetermined ranges.

14. The method of claim 11, further comprising:

monitoring gases received as the fluid within the enclosed space; and determining integrity of the seal against one of the housing and the hanger based at least in part on the gasses being well-formation gasses.

15. The method of claim 11, wherein the fluid is applied under pressure to the port for a predetermined time period at predetermined time intervals.

16. The method of claim 11, further comprising:

drilling a plurality of holes of predetermined lengths into material of the seal from a plurality of different positions external to the seal so that each of the plurality of holes intersect another one of the plurality of holes to create the enclosed space for fluid communication through the plurality of holes;

welding external accesses to close at least one of the plurality of holes; and leaving open at least two of the plurality of holes for access to the port and for access to the hanger, the fluid communication occurring between the port and the access to the hanger in normal operation.

17. The method of claim 11, further comprising:

drilling a hole in the housing for the port; and ensuring the hole accesses an access hole of the enclosed space in the first section of the seal during normal operation with the seal energized.

18. The method of claim 11, further comprising:

machining a middle section of the seal to form at least a channel between a bottom of the seal and a lock ring energizer element, the channel forming part of the enclosed space in the seal.

19. The method of claim 11, further comprising:

energizing the seal using an energizing ring filling the space for normal operations, the energizing causing the first section of the seal to press against the housing and for causing the second section of the seal to press against the hanger.

20. The method of claim 11, wherein the enclosed space within the seal is formed by one or more of: Electrical Discharge Machining (EDMing), 3-Dimensional (3D) printing, powder sintering, and casting.

* * * * *